US006276367B1

(12) United States Patent
Piatetsky

(10) Patent No.: US 6,276,367 B1
(45) **Date of Patent: *Aug. 21, 2001**

(54) LIQUID-RESERVOIR HAIRBRUSH

(76) Inventor: Andrey Piatetsky, 5702 Rhea Ave., Tarzana, CA (US) 91356

( * ) Notice: Subject to any disclaimer, the term of this patent is extended or adjusted under 35 U.S.C. 154(b) by 0 days.

This patent is subject to a terminal disclaimer.

(21) Appl. No.: 09/667,883

(22) Filed: Sep. 22, 2000

Related U.S. Application Data

(63) Continuation-in-part of application No. 09/510,210, filed on Feb. 22, 2000, now Pat. No. 6,158,442.

(51) Int. Cl.[7] ..... A45D 24/22
(52) U.S. Cl. ..... 132/115
(58) Field of Search ..... 132/108, 109, 132/110, 111, 112, 113, 114, 115, 120, 147, 148; 401/268, 274, 282, 283, 286, 287; 15/205.2

(56) References Cited

U.S. PATENT DOCUMENTS

| | | | | |
|---|---|---|---|---|
| 1,462,400 | * | 7/1923 | Warren | 132/113 |
| 1,552,234 | | 9/1925 | Roebuck . | |
| 3,101,086 | | 8/1963 | Di Vito . | |
| 3,203,025 | * | 8/1965 | Schreur | 132/112 |
| 3,721,250 | | 3/1973 | Walter et al. . | |
| 3,964,501 | | 6/1976 | Matchett . | |
| 4,055,195 | | 10/1977 | Moses . | |
| 4,585,018 | * | 4/1986 | O'Connor | 132/120 |
| 4,867,183 | * | 9/1989 | Busch et al. | 132/110 |
| 4,913,172 | * | 4/1990 | Chou | 132/118 |
| 5,154,193 | * | 10/1992 | Busch et al. | 132/110 |
| 5,787,586 | | 8/1998 | Apprille, Jr. et al. . | |
| 5,927,290 | | 7/1999 | Thiruppathi . | |

* cited by examiner

*Primary Examiner*—Gene Mancene
*Assistant Examiner*—Eduardo C. Robert
(74) *Attorney, Agent, or Firm*—Christie, Parker & Hale, LLP

(57) ABSTRACT

A liquid-reservoir hairbrush that is capable of evenly dispersing water-based solutions and other thin and non-viscous liquids over the user's scalp during routine hair brushing. Absorbent filler unit(s) are placed into a chamber of the hairbrush body and absorbent feed rods are placed into bores of the hairbrush bristles. The hairbrush can be provided with roller-ball or felt-tipped nozzles mounted at distal ends of the hairbrush bristles. The absorbent feed rods interconnect the absorbent filler unit(s) and the nozzles, and the liquid from the absorbent filler unit(s) is supplied to the absorbent feed rods and then to the nozzles. The chamber of the hairbrush body can be divided into multiple, hermetically isolated sections. The hairbrush body can have an optional filler inlet and can come with an optional liquid refilling unit which can hold a predetermine volume of the liquid. The hairbrush comes with a removable bristle lid to keep the bristles enclosed when the hairbrush is not in use and to help prevent the nozzles from drying out.

19 Claims, 11 Drawing Sheets

LIQUID-RESERVOIR HAIRBRUSH

CROSS-REFERENCE TO RELATED APPLICATIONS

This is a continuation-in-part of U.S. patent application Ser. No. 09/510,210, filed on Feb. 22, 2000, now U.S. Pat. No. 6,158,442.

FIELD OF THE INVENTION

The present invention relates to the liquid-reservoir hairbrushes particularly well designed for dispersing low viscosity water-based solutions and other thin and non-viscous liquids over the user's scalp.

BACKGROUND OF THE INVENTION

Liquid-reservoir hairbrushes and combs have been available for years. In addition to combing and brushing, these devices allow a user to distribute water and oil-based solutions over the user's scalp and/or hair. In some of these devices, liquid outlets (viz., nozzles) are mounted at distal ends of teeth or bristles. In other devices, the nozzles are located near proximal ends of the teeth or bristles (usually between them) or at a body of the hair device. However, these prior art devices have a variety of shortcomings.

For example, if the user wants to disperse the liquid only over the scalp, and the nozzle(s) are located at a bristle area of the body of the brush (e.g. U.S. Pat. No. 5,927,290 to Thiruppathi) or between the comb teeth (e.g. U.S. Pat. No. 3,964,501 to Matchett), the liquid dispensed from the nozzle initially deposits on the user's hair and wets the hair and only thereafter contacts the user's scalp. This can makes the user's hair excessively wet and uncomfortable.

Moreover, because a diameter of the nozzle is much smaller than a size of a liquid reservoir, different types of pumps are used to force the liquid flow through the nozzle. Accordingly, a person using this type of device has to adjust the liquid flow dispensed through the nozzle by operating different types of control mechanisms (e.g. U.S. Pat. No. 3,721,250 to Walter and U.S. Pat. No. 5,927,290 to Thiruppathi). Since the user usually has to perform the above procedure during hair brushing or combing, the prior art liquid-reservoir hairbrushes and combs with pumps are relatively complicated to operate.

Furthermore, there are other problems associated with the dispersion of water-based solutions and other thin and non-viscous liquids over the user's scalp for the devices with pumps. If the nozzles are mounted within the ends of the brush bristles or comb teeth (e.g. U.S. Pat. No. 3,101,086 to Di Vito), it would appear to be troublesome to control the liquid flow through the nozzles. Since most of the above devices have open-end teeth or bristles, the liquid will come out from the nozzles whether or not there is a contact with the user's scalp. Because all brush bristles or comb teeth cannot entirely contact the user's scalp simultaneously, the excessive liquid disperses between the user's hair and makes them wet. Others have attempted to devise ways to work around this problem. For example, U.S. Pat. No. 4,055,195 to Moses discloses a fluid-reservoir hair comb with roller-balls mounted within the end of each comb tooth. Although the roller-ball installed within the nozzle can partially control a high viscosity liquid flow of the oil-based solutions dispensed from the particular nozzle, the Moses construction is absolutely not acceptable for the low viscosity water-based solutions and other thin and non-viscous liquids. A well-known effect (previously described for ball point pens) of natural outflow of liquid through a gap between the roller-ball and an internal wall of the roller-ball seat, a so-called direct-flow phenomenon, in which air flows in through the gap to allow the liquid to flow out from the liquid reservoir, is liable to take place. Even more, there are another two potential problems for the users of the Moses device. First, the Moses reference notes that the roller-ball installed within the nozzle of the comb tooth can release the liquid only upon moving contact of the roller-ball with the user's scalp. Since, the human head is curved, just a few comb teeth usually contact the user's scalp with each pass of the comb through the person's hair. Therefore, it is very likely that the user of the Moses device will not be able to evenly dispense a sufficient amount of the liquid over the scalp during routine hair combing. Second, because of the high viscosity of the oil-based solutions, the person using the Moses comb has to apply an additional abnormal pressure to the comb to be able move the roller-balls inside of the nozzles while combing.

None of these prior art hair combs and brushes are designed to efficiently and evenly disperse the water-based solutions and other thin and non-viscous liquids over the user's scalp. Accordingly, there is a need for a liquid reservoir hair device that will allow the user to conveniently and evenly disperse the water-based and other thin and non-viscous liquids over the scalp during routine hair combing or brushing.

BRIEF DESCRIPTION OF THE INVENTION

It is a first object of the invention to provide a liquid-reservoir hairbrush that is capable of dispersing water-based solutions and other thin and non-viscous liquids over the user's scalp during routine hair combing or brushing. The first object is achieved by locating at least one absorbent filler unit (viz., liquid absorbent) in a chamber of the hairbrush body and absorbent feed rods in bores of the hairbrush bristles. The hairbrush bristles are preferably mounted to a flexible base and the absorbent filler unit(s) are preferably made from a sufficiently spongy and/or springy material. The absorbent filler unit(s) are placed into the chamber of the hairbrush body and covered by the flexible base. Liquid outlets (viz., nozzles) are mounted at distal ends of the hairbrush bristles and have a roller-ball liquid distribution mechanism, in which roller-balls are rotatably mounted within each nozzle to disperse the liquid over the user's scalp only during rolling contact of the roller-ball with the user's scalp. The absorbent feed rods interconnect the absorbent filler unit(s) and the roller-balls, and the liquid from the absorbent filler unit(s) is supplied to the roller-balls, by means of the liquid passing through the absorbent feed rods to feed a surface of each roller-ball. When the user brushes his or her hair, the hairbrush bristles push on the flexible base and pressurize the absorbent filler unit(s). This pressure helps to move the liquid from the absorbent filler unit(s) down to the absorbent feed rods. The hairbrush body can have an absorbent filler divider which separates the chamber of the hairbrush body into multiple, hermetically isolated sections, and multiple absorbent filler units can be placed into these sections. A purpose of the separation is to keep the hairbrush in an overall workable condition, even if some of the nozzles and/or the hairbrush bristles leak and the liquid starts to drain or vaporize from the absorbent filler unit(s). The hairbrush can be provided with a removable bristle lid to keep the hairbrush bristles enclosed when the hairbrush is not in use, and to prevent the roller-balls from drying out. A body of the hairbrush will preferably have a filler inlet, so that the user can refill the absorbent filler unit(s) with the liquid with or without an optional liquid refilling unit which can hold a predetermine volume of the liquid.

It is another object of the invention to provide a hairbrush with bristles having roller-ball nozzles, wherein an intermediate transitional absorbent unit is mounted between an absorbent feed rod and a roller-ball. A main purpose of the intermediate absorbent unit is to provide a transition between the absorbent feed rod and a possibly dissimilar sized roller-ball.

It is further object of the invention to provide a hairbrush with bristles having felt-tipped nozzles mounted at distal ends of the brush bristles, wherein an absorbent dispersing unit is mounted within each nozzle, and wherein an absorbent feed rod extends outwardly beyond the distal end of each hairbrush bristle and extends into the absorbent dispersing unit. Liquid from an absorbent filler unit is supplied through the absorbent feed rod in a direction of the absorbent dispersing unit to feed a surface of a distal end of the absorbent dispersing unit. The liquid from the felt-tipped nozzle disperses over the user's scalp upon contact of the distal end of the absorbent dispersing unit with the scalp during brushing. These types of nozzles may provide a softer feeling brush for users with a sensitive scalp.

BRIEF DESCRIPTION OF THE DRAWINGS

The invention is set forth in greater detail, with reference to the drawings, but is not so limited.

DETAILED DESCRIPTION OF THE INVENTION

Figure 1:
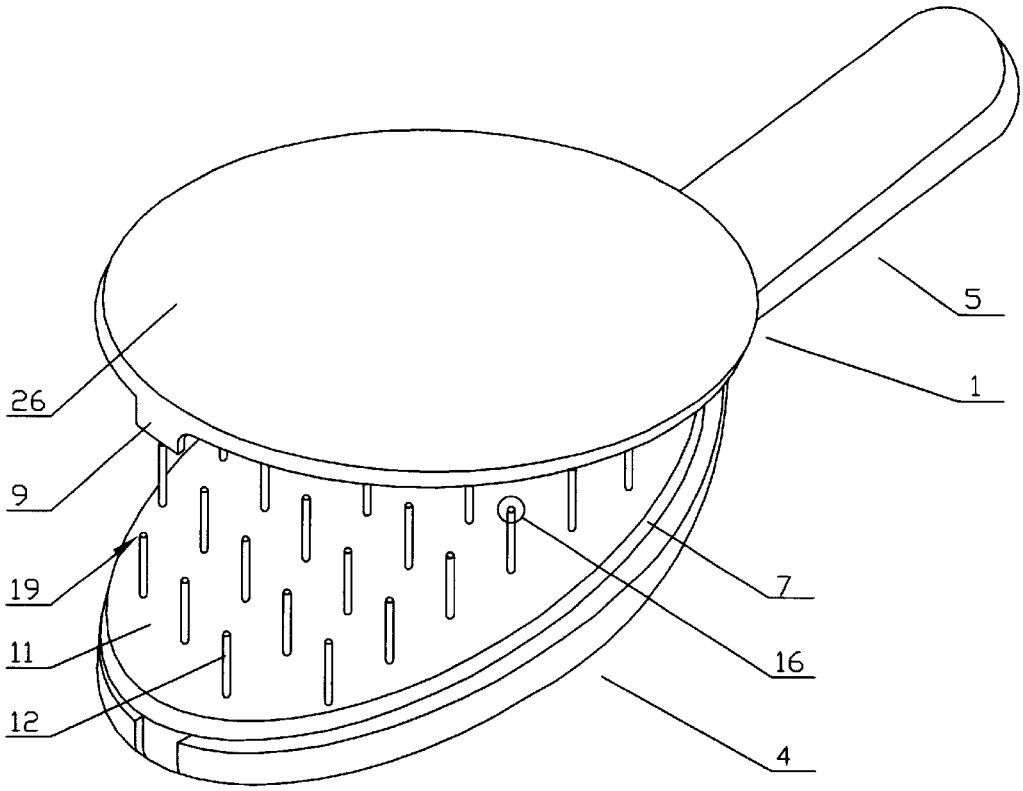
FIG. 1 is a perspective view of a first embodiment of the hairbrush in accordance with the invention. A bristle lid is partially open and a bristle area is shown.
Figure 2:
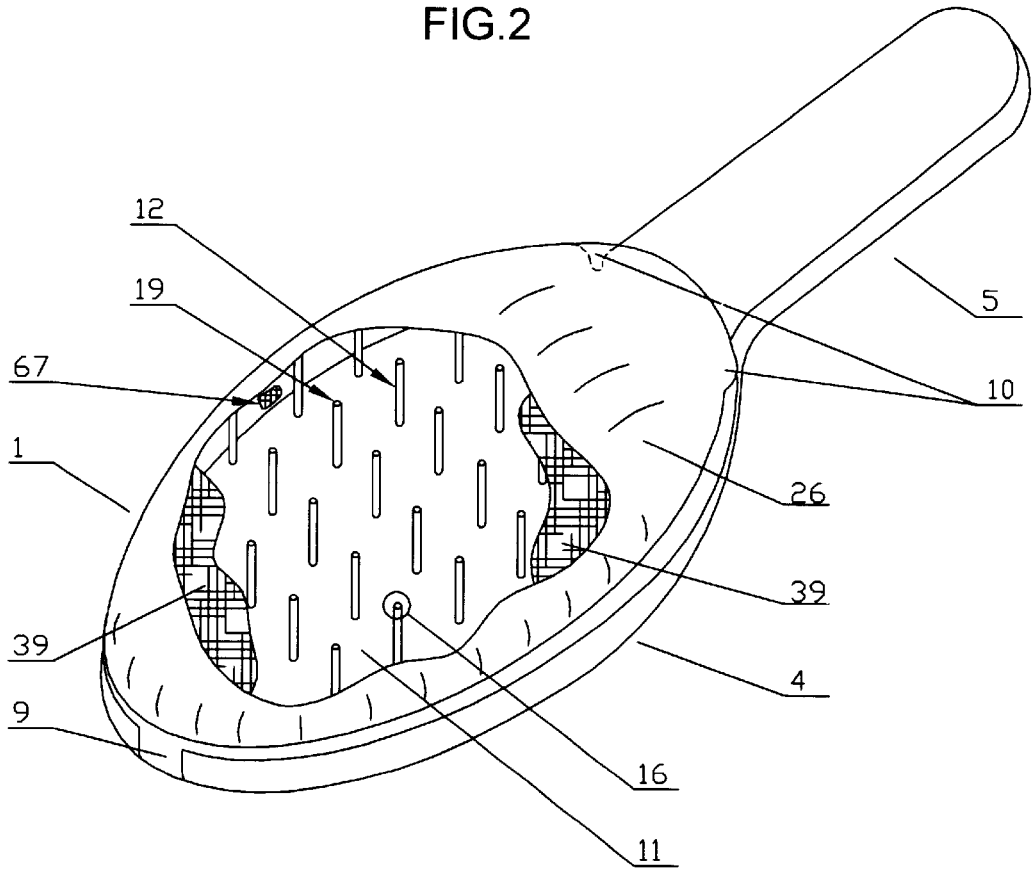
FIG. 2 is a perspective view of the hairbrush of FIG. 1 with the bristle lid closed and partially exposed to show the bristle area and the bristle lid's cleaning pad.
Figure 3:
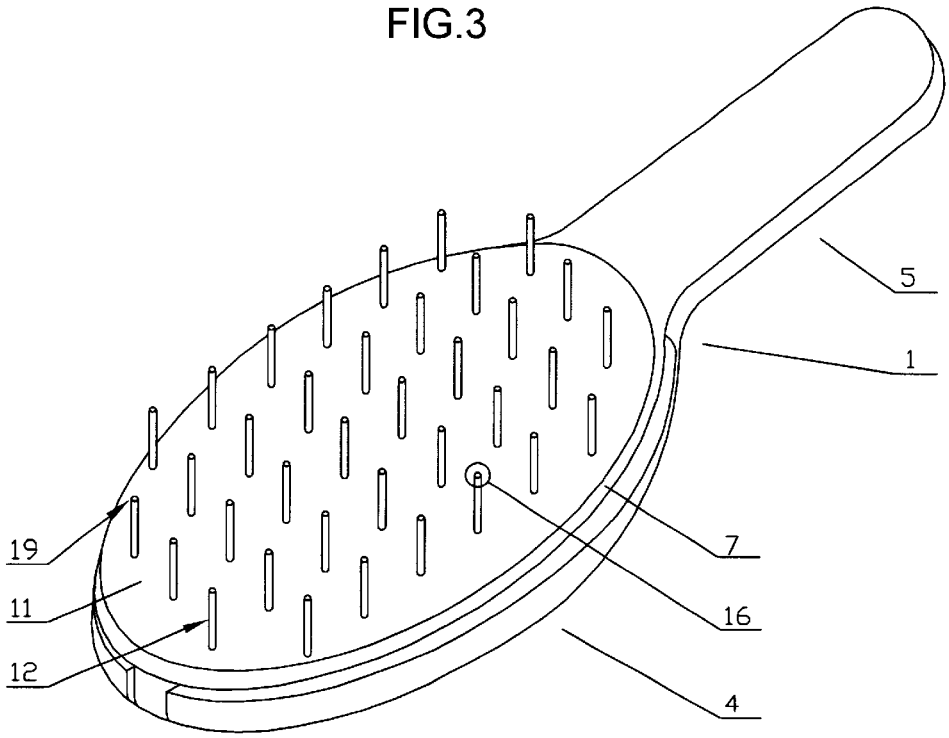
FIG. 3 is a perspective view of the hairbrush of FIG. 1 shown without the bristle lid.

The major goal of the present invention is to provide a liquid-reservoir hairbrush that will allow a user to conveniently and evenly disperse water-based solutions and other thin and non-viscous liquids over the scalp during routine hair combing or brushing.

One great advantage of a hairbrush or comb with liquid outlets (viz., nozzles) located at distal ends of comb teeth or hairbrush bristles and having a roller-ball liquid distribution mechanism is that the liquid from each particular nozzle will be released only upon moving contact of the roller-ball mounted within that nozzle with the user's scalp.

To prevent a natural outflow of a liquid through the roller-ball nozzles mounted at the distal ends of the hairbrush bristles, and to transport the liquid from the liquid reservoir down to the roller-ball nozzles, for all embodiments of the hairbrush of the invention absorbent filler unit(s) will be placed into the hairbrush's liquid reservoir, and absorbent feed rods will be placed into bores of the hairbrush bristles. With respect to the above described design, there are two main reasons why a hairbrush construction is more preferable than a comb construction for efficiently dispersing of the liquid over the user's scalp from the roller-ball nozzles. First, usually just a few comb teeth can contact the user's scalp with each pass of the comb through the person's hair. Thus, it will be very likely, that if the roller-ball nozzles are mounted at the ends of the comb teeth, the user of this type of comb will not be able to evenly disperse a sufficient amount of the liquid over the scalp during typical hair combing. The hairbrush construction will have a greater number of bristles in contact with the user's scalp at any given time. Second, the hairbrush construction permits the bristles to be mounted to a base that can be formed from a flexible material. When pressure is applied to the hairbrush bristles while brushing, the flexible base moves upwardly, thereby pressurizing the absorbent filler unit (if the absorbent filler unit is made from sufficiently spongy and/or springy material) and helps to move the liquid from the absorbent filler unit down to the absorbent feed rods located in the bores of the hairbrush bristles.

The following features are combined in one device in the present invention to accomplish convenient and even dispersion of water-based solutions and other thin and non-viscous liquids over the user's scalp during routine hair combing or brushing:

(a) The device will have at least two and preferably several rows of the hairbrush bristles preferably mounted to a flexible base;

(b) The device will have a liquid reservoir at least partially filled with at least one absorbent filler unit;

(c) At least one bore will be formed through at least some of the hairbrush bristles, and at least one absorbent feed rod will be placed into each bore;

(d) Liquid outlets (viz., nozzles) will be mounted at distal ends of the hairbrush bristles to accomplish even dispersion of the liquid over the user's scalp;

(e) The nozzles located at the distal ends of the hairbrush bristles can have:
- a roller-ball liquid distribution mechanism, or
- a felt-tipped design, wherein the absorbent feed rod will extend outwardly from the distal end of each hairbrush bristle and contacts an absorbent dispersing unit mounted within each nozzle, and wherein the liquid from the felt-tipped nozzle disperses over the user's scalp upon contact of the distal end of the absorbent dispersing unit with the scalp during brushing; and (f) The absorbent filler unit(s) and the absorbent feed rods will be used to transport the liquid from the liquid reservoir down to the nozzles located at the distal ends of the hairbrush bristles, and to prevent a natural outflow of the liquid through the roller-ball nozzles.

Figure 7:
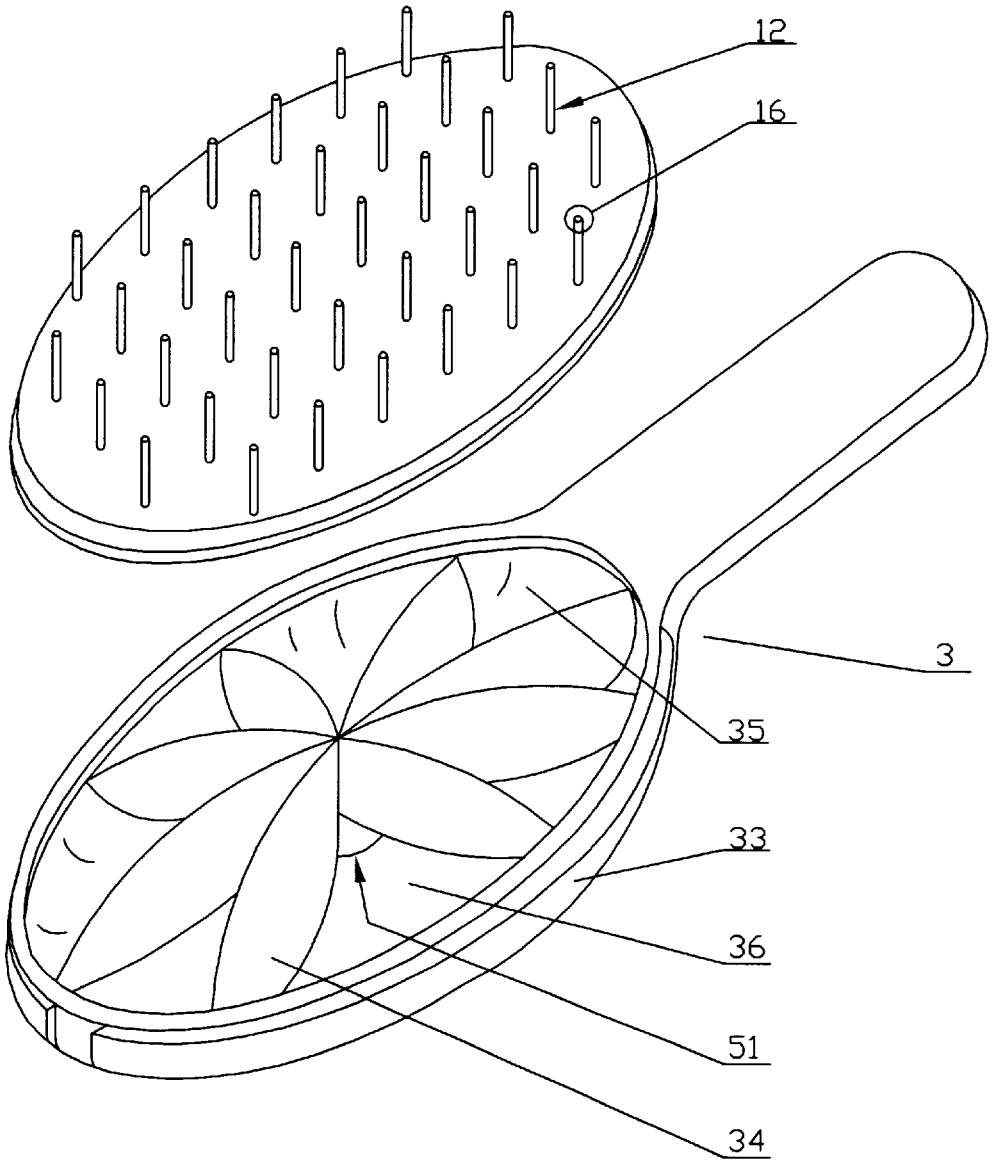
FIG. 7 is an exploded perspective view of a third embodiment of the hairbrush in accordance with the invention with a bristle frame removed to show a divider for an absorbent filler unit.
Figure 8:
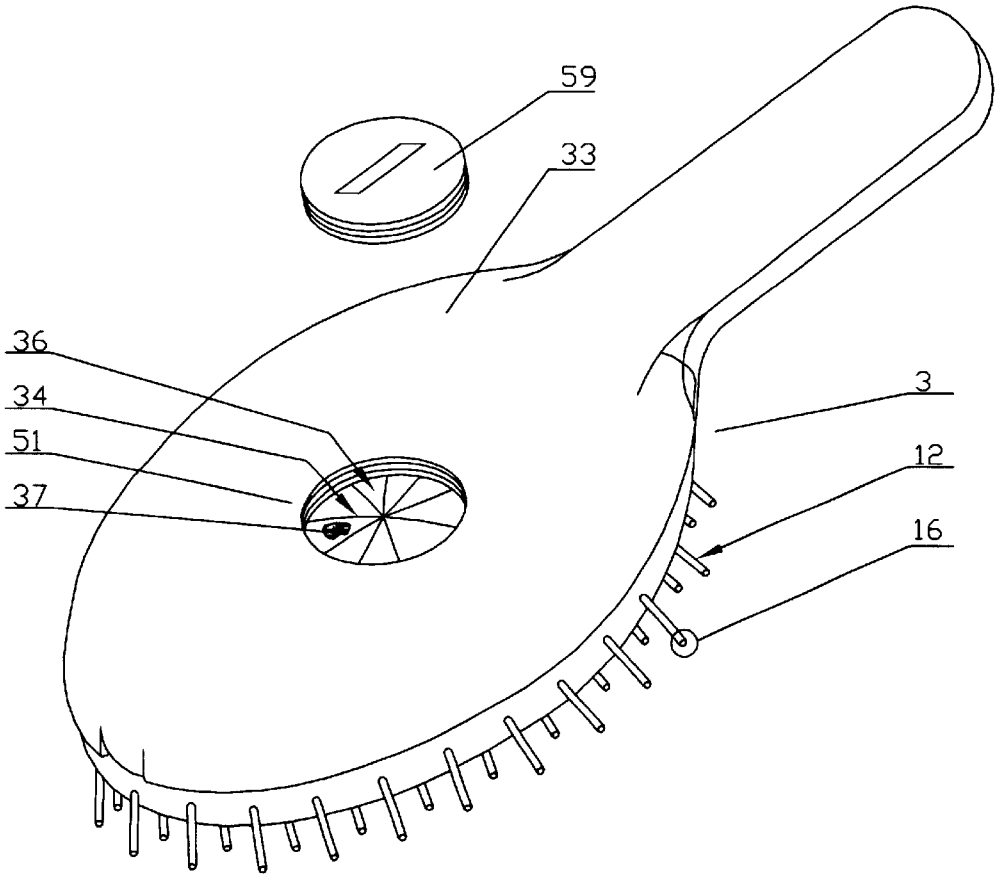
FIG. 8 is a perspective view of the hairbrush of FIG. 7 with a filler cap removed from a filler inlet to show the absorbent filler divider and the absorbent filler unit.

Three different embodiments of the hairbrush of the invention are presented. A first embodiment (FIGS. 1–5) is shown in general as 1. A second embodiment (FIG. 6) is shown in general as 2. A third embodiment (FIGS. 7–8) is shown in general as 3.

Figure 4:
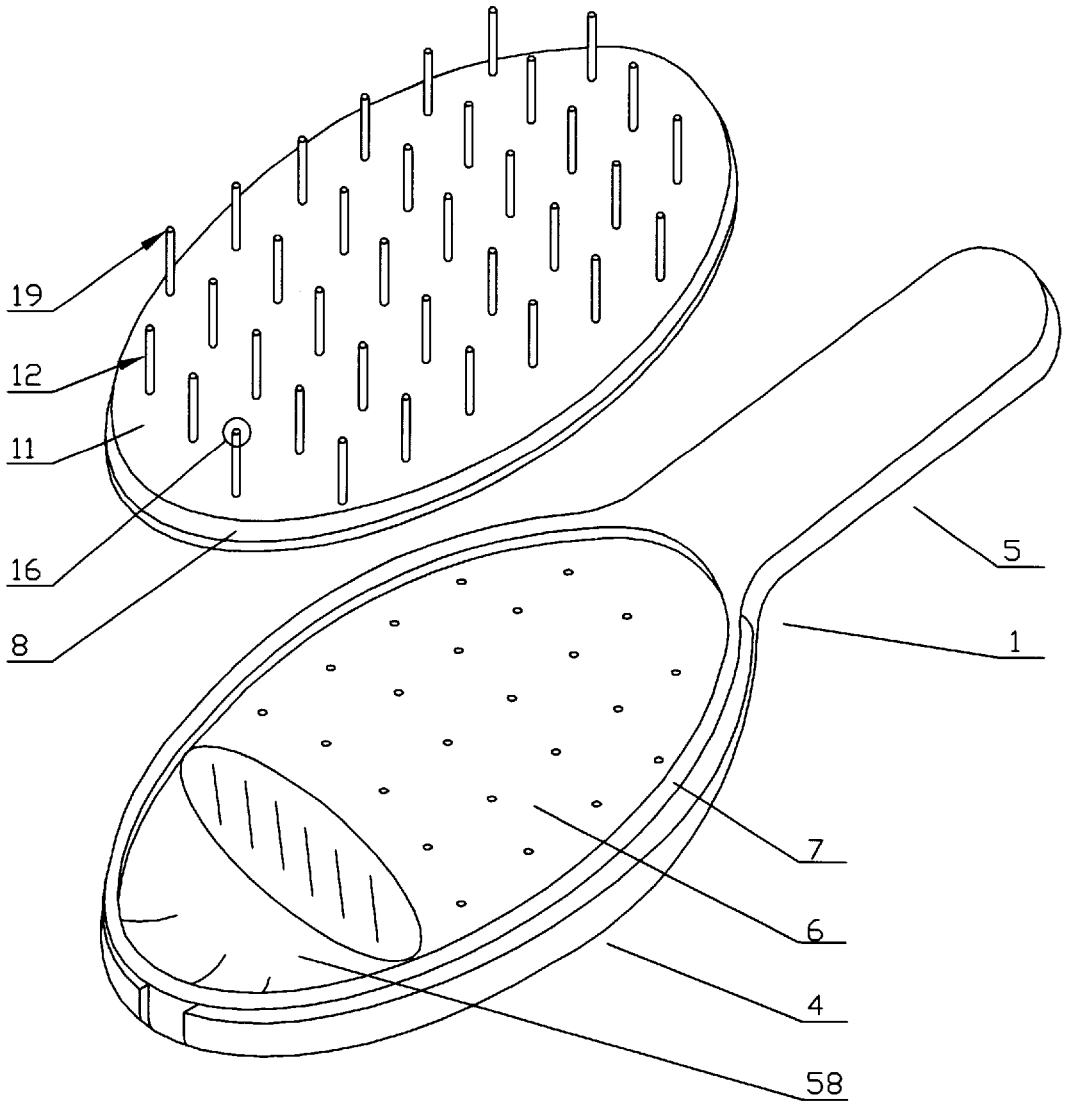
FIG. 4 is an exploded perspective view of the hairbrush of FIG. 1 with a bristle frame removed to show a partially exposed absorbent filler unit.
Figure 5:
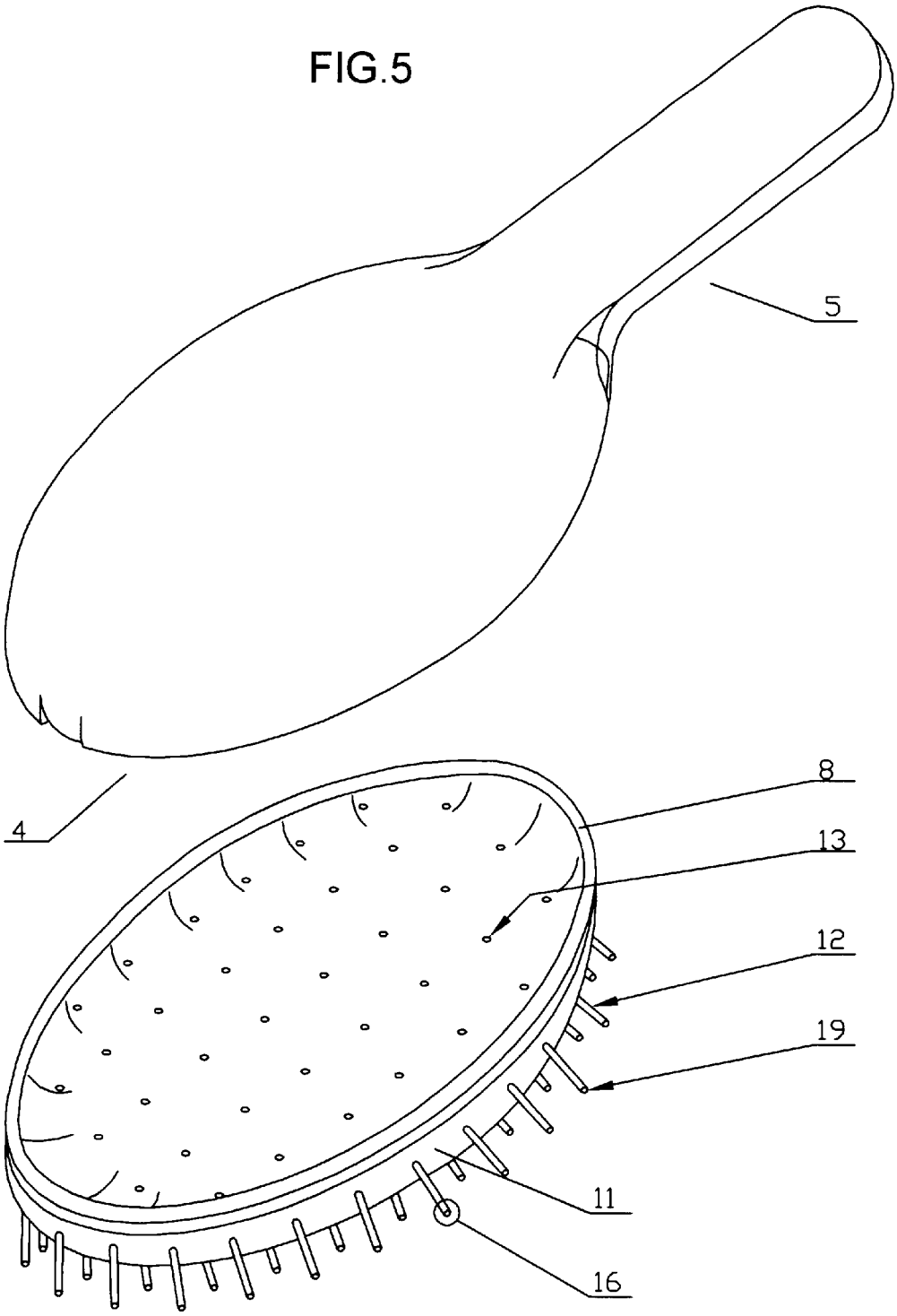
FIG. 5 is an exploded perspective view of the hairbrush of FIG. 1 with the bristle frame removed to show bores of the hairbrush bristles.
Figure 9:
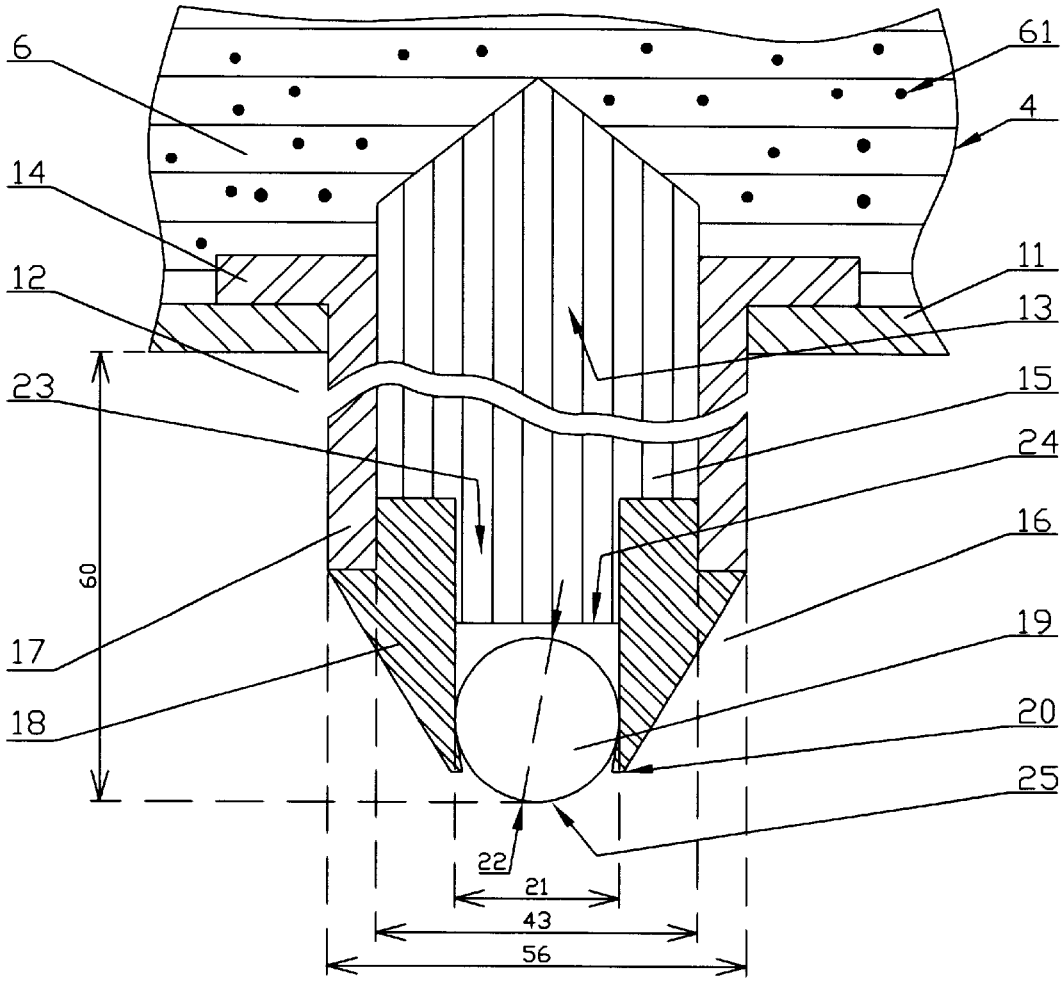
FIG. 9 is a cross-sectional view of a first embodiment of the hairbrush bristle showing a roller-ball nozzle and a connection between the absorbent filler unit and an absorbent feed rod.

Referring to the first embodiment (FIGS. 1–5), a hairbrush 1 has a body 4, a handle 5 and a bristle lid 26. The body 4 has a chamber 58 (FIG. 4), an absorbent filler unit 6, a hairbrush frame 7 and a bristle frame 8 (FIGS. 4–5). The bristle lid 26 has a catch clip 9 and two holders 10 which engage with the hairbrush body 4 near the handle 5 to permit detachable engagement of the bristle lid 26 with the body 4 of the hairbrush 1. The bristle frame 8 has a flexible base 11 with a plurality of bristles 12. A diameter 56 (FIG. 9) of each bristle 12 is preferably between 1.5 mm and 2.8 mm, and a length 60 is preferably between 1.5 cm and 3 cm, however other sizes can be provided as well. All of the above hairbrush parts are preferably made from plastic, but can also be made from other known materials. The flexible base 11 is preferably made from a flexible material, such as rubber or plastic. The absorbent filler unit 6 is placed into the chamber 58 and covered by the bristle frame 8. The bristle frame 8 is preferably hermetically attached (e.g. by adhesives, welding, etc) to the hairbrush frame 7. The plurality of the bristles 12 extend outwardly from the flexible base 11 held in the bristle frame 8. The flexible base 11 is preferably hermetically attached to the bristle frame 8 (e.g. by adhesives, welding, etc). Referring to a first embodiment of the hairbrush bristles 12, each bristle 12 (FIG. 9) has a bore 13, a bristle ring 14, an absorbent feed rood 15 and a roller-ball nozzle 16. Each bristle 12 is preferably hermetically attached (e.g. by adhesives, welding, etc) to the flexible base 11 by inserting the bristle ring 14 into the flexible base 11. The roller-ball nozzle 16 is mounted at a distal end 17 of the bristle 12. The bore 13 is fully filled by the absorbent feed rod 15 and the absorbent feed rod 15 extends into the hairbrush body 4 and into the absorbent filler unit 6 and contacts the absorbent filler unit 6. The absorbent filler unit 6 can be formed from a mass or bundles of fibers with a preferable porosity of about 60%, although other porosities will also function. The absorbent filler unit 6 can also be formed from plastic or other known materials. The absorbent filler unit 6 is preferably made from a sufficiently spongy and/or springy material. The size of the absorbent filler unit 6 may preferably be between 80 $cm^3$; and 120 $cm^3$, so the total amount of the liquid which can be retained by the absorbent filler unit 6 will be approximately between 48 ml and 72 ml, however other sizes can be provided as well. The absorbent feed rod 15 can be formed from a bundle of resin-bonded fibers, however other known material can be used as well. A diameter 43 of the absorbent feed rod 15 may preferably be between 1 mm and 2.5 mm, however other sizes can be provided as well. The roller-ball nozzle 16 is mounted at the distal end 17 of the bristle 12 and comprises a roller-ball seat 18 and a roller-ball 19. The roller-ball seat 18 has a rim structure 20 to retain the roller-ball 19 within the roller-ball seat 18. The roller-ball 19 partially extends outwardly beyond the roller-ball nozzle 16 in order to contact the user's scalp during brushing. The roller-ball 19 and the roller-ball seat 18 can be made from stainless steel or other known materials. The roller-ball 19 can also be made from a porous composite material, porous stainless steel or other known porous material. Use of a porous roller-ball 19 can improve the dispersion of the liquid from the roller-ball nozzle 16. A diameter 22 of the roller-ball 19 is preferably between 1.5 mm–2.5 mm, however other sizes can be provided as well. An internal diameter 21 of the roller-ball seat 18 is preferably 0.075 mm–0.15 mm larger than the diameter 22 of the roller-ball 19, however other size difference can be provided as well. An axial hole 23 is formed through the roller-ball seat 18, and a distal end 24 of the absorbent feed rod 15 extends inwardly into the axial hole 23 and contacts the roller-ball 19 for supplying the liquid to a surface 25 of the roller-ball 19. The absorbent feed rod 15 interconnects the absorbent filler unit 6 and the roller-ball 19. The hairbrush 1 can come pre-filled with a liquid 61 (e.g. a water-based medicated solution). The liquid 61 from the absorbent filler unit 6 is supplied to the roller-ball 19 by means of the liquid 61 passing through the absorbent feed rod 15 to feed the surface 25 of the roller-ball 19. The roller-ball 19 is mounted within the roller-ball seat 18 for rotation movement to transfer the liquid 61 from the distal end 24 of the absorbent feed rod 15 to the user's scalp upon rotation contact of the roller-ball 19 with the user's scalp. Since the bristles 12 are connected to the flexible base 11, when the user brushes his or her hair, the flexible base 11 moves upwardly, thereby pressurizing the absorbent filler unit 6 and helps to move the liquid 61 from the absorbent filler unit 6 down to the absorbent feed rods 15. The bristle lid 26 (FIGS. 1–2) is provided to keep the hairbrush bristles 12 enclosed when the hairbrush 1 is not in use and helps prevent the roller-balls 19 from drying out. The bristle lid 26 can be provided with an optional cleaning pad 39 (FIG. 1). The cleaning pad 39 is attached (e.g. by adhesives, welding, etc) to an inside surface 67 of the bristle lid 26. The cleaning pad 39 is preferably made from a sufficiently spongy plastic material with a textured surface. The cleaning pad 39 covers and contacts the roller-ball nozzles 16 when the bristle lid 26 is closed and therefore cleans the roller-ball nozzles 16 after every brushing when the user closes the bristle lid 26 onto the bristles 12. The bristle lid 26 is conveniently removably mounted to the hairbrush body 4 by the catch clip 9 and two holders 10.

Figure 6:
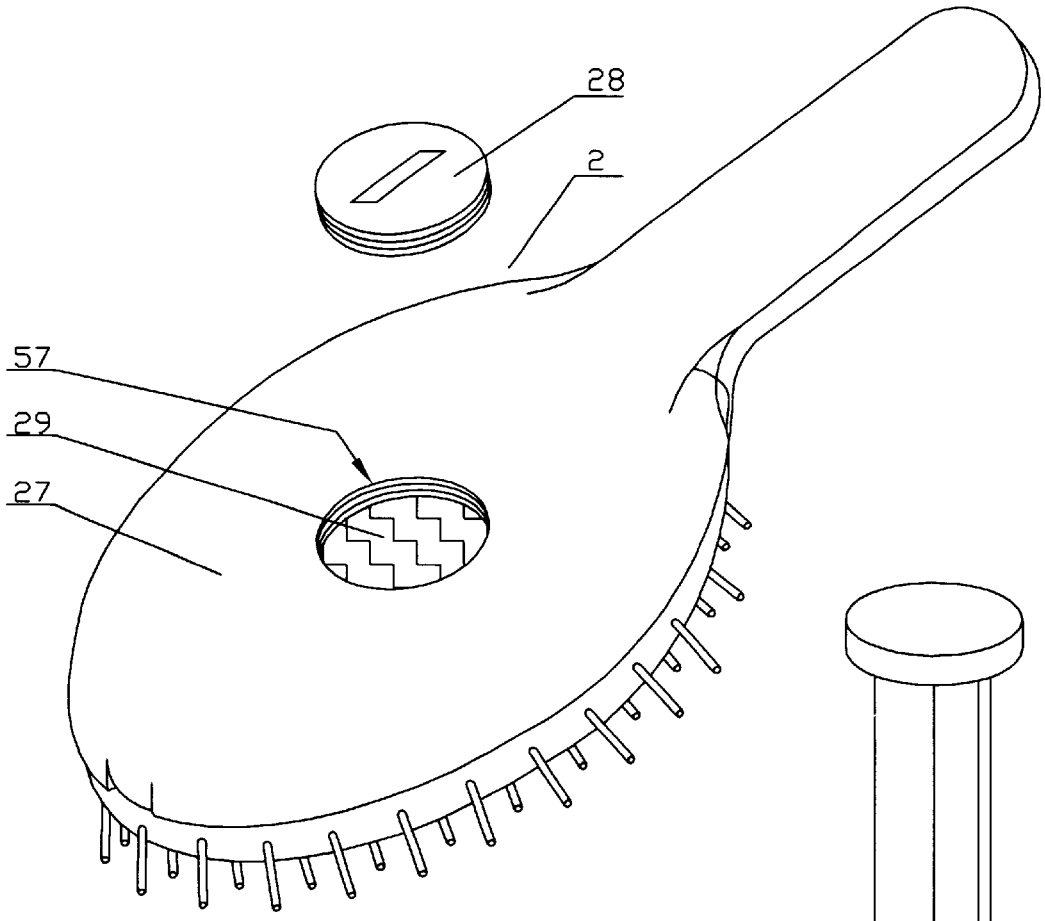
FIG. 6 is a perspective view of a second embodiment of the hairbrush in accordance with the invention. A filler cap is removed from a filler inlet and an absorbent filler unit is shown.
Figure 6A:
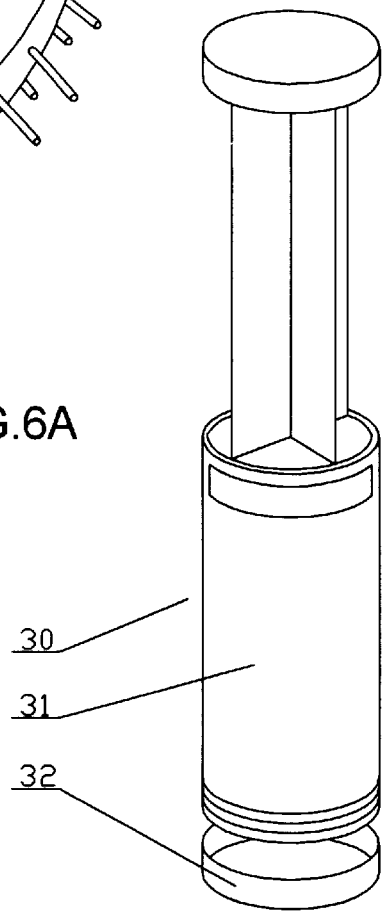
FIG. 6*a* is a perspective view of an optional liquid refilling unit.

Referring to FIG. 6, the second embodiment of the hairbrush 2 is similar to the first embodiment 1 (FIGS. 1–5), except that the hairbrush body 27 has a filler inlet 57 and a filler cap 28, so the user can refill the absorbent filler unit 29 with or without an optional liquid refilling unit 30 (FIG. 6*a*). The liquid refilling unit 30 has a syringe construction and can hold a predetermine volume of the liquid depending on the particular design of the hairbrush 2 and the liquid capacity of the absorbent filler unit 29. The liquid refilling unit 30 is preferably made from a plastic material and has a body 31 and a cap 32. The liquid refilling unit 30 can be pre-filled with the liquid.

The third embodiment of the hairbrush 3 (FIGS. 7–8) is similar to the second embodiment 2 (FIG. 6), except that a hairbrush body 33 has an absorbent filler divider 34 which separates a chamber 35 of the hairbrush body 33 into multiple (e.g. eight) sections 36. The absorbent filler divider 34 is preferably made from the same material as a hairbrush body 33. Absorbent filler units 37 are placed into each section 36, and when a filler inlet 51 is closed by a filler cap 59, the above sections 36 are preferably hermetically isolated from one another. A purpose of the absorbent filler divider 34 is to keep the hairbrush 3 in an overall workable condition, even if some of the roller-ball nozzles 16 and/or the bristles 12 leak and the liquid starts to drain or vaporize from the absorbent filler units 37.

Figure 10:
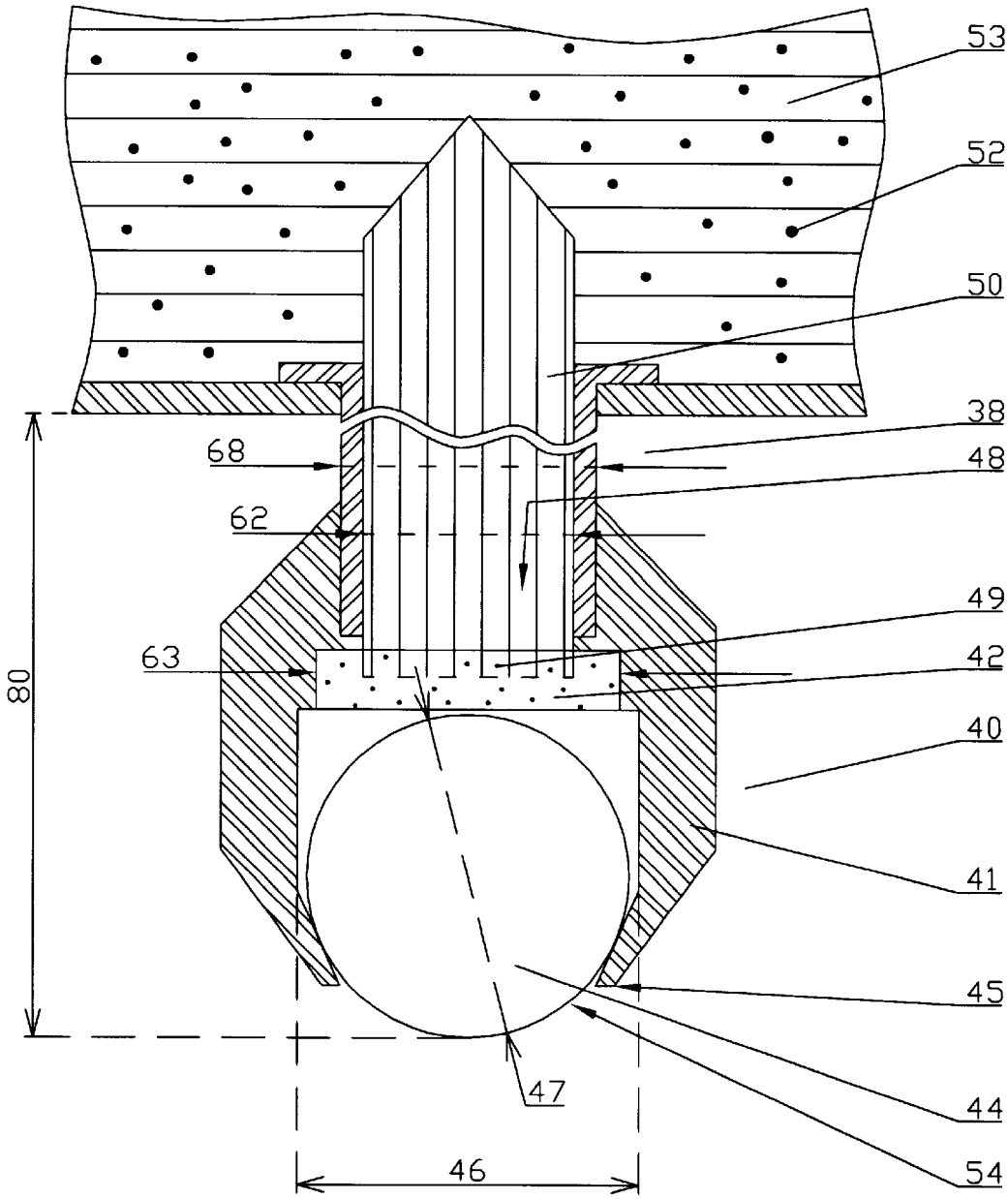
FIG. 10 is a cross-sectional view of a second embodiment of the hairbrush bristle showing an optional roller-ball nozzle, wherein an intermediate transitional absorbent unit is mounted within the nozzle between the roller-ball and the absorbent feed rod.

Referring to FIG. 10, a second embodiment of a hairbrush bristle 38 can be provided for all three embodiments of the hairbrush 1, 2 and 3 of the invention, wherein the bristle 38 is similar to the bristle 12 (FIG. 9), except that the bristle 38 has an optional type of a roller-ball nozzle 40. A diameter 68 of each bristle 38 is preferably between 1.5 mm and 2.5 mm, and a length 80 is preferably between 1.5 cm and 3 cm, however other sizes can be provided as well. The roller-ball nozzle 40 comprises a roller-ball seat 41, an intermediate transitional absorbent unit 42 and a roller-ball 44. The roller-ball seat 41 has a rim structure 45 to retain the roller-ball 44 within the roller-ball seat 41. The roller-ball 44 partially extends outwardly beyond the roller-ball seat 41 in order to contact the user's scalp during brushing. The roller-ball 44 and the roller-ball seat 41 can be made from stainless steel or other known materials. The roller-ball 44 can also be made from a porous composite material, porous stainless steel or other known porous material. The diameter 47 of the roller-ball 44 is preferably between 2.5 mm and 4 mm, however other sizes can be provided as well. An internal diameter 46 of the roller-ball seat 41 is preferably 0.075 mm–0.15 mm larger than a diameter 47 of the roller-ball 44, however other size difference can be provided as well. An axial hole 48 is formed through the roller-ball seat 41, and a distal end 49 of an absorbent feed rod 50 extends inwardly into the axial hole 48 and is adjacent to or contacts the intermediate transitional absorbent unit 42. A diameter 62 of the absorbent feed rod 50 is preferably between 1 mm and 2.2 mm, however other sizes can be provided as well. The intermediate transitional absorbent unit 42 is mounted within the roller-ball nozzle 40 between the absorbent feed rod 50 and the roller-ball 44 and is adjacent to or contacts the roller-ball 44. The intermediate transitional absorbent unit 42 preferably has a cylindrical configuration with a preferable diameter 63 equal to the diameter 47 of the roller-ball 44, however other sizes can be provided as well. An amount of liquid 52 that the user can disperse over the scalp from the roller-ball nozzle 40 partially depends from the size (viz., the diameter 47) of the roller-ball 44. Since the diameter 62 of the absorbent feed rod 50 is limited by the diameter 68 of the bristle 38 (the brush bristle with a relatively large diameter will be very inconvenient for brushing), the main purpose of the intermediate transitional absorbent unit 42 is to provide a transition between the absorbent feed rod 50 (with diameter 62) and the roller-ball 44 with a possibly dissimilar sized diameter 47. The liquid 52 from an absorbent filler unit 53 is supplied to the roller-ball 44 by means of the liquid 52 passing through the absorbent feed rod 50 and through the intermediate transitional absorbent unit 42 to feed a surface 54 of the roller-ball 44. The roller-ball 44 is mounted within the roller-ball seat 41 for rotational movement to transfer the liquid 52 from a distal end 49 of the intermediate transitional absorbent unit 42 to the user's scalp upon rotational contact of the roller-ball 44 with the user's scalp.

Figure 11:
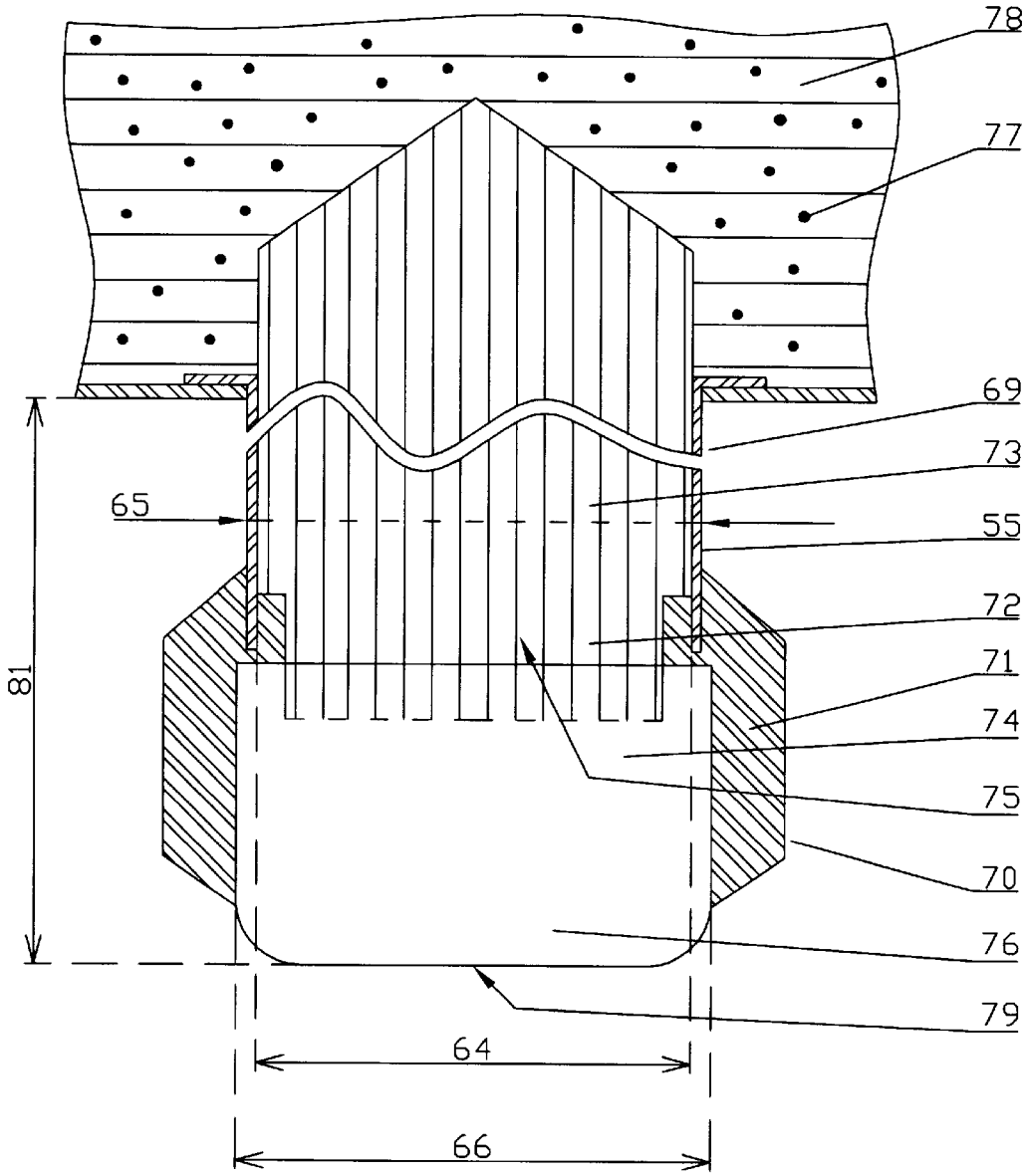
FIG. 11 is a cross-sectional view of a third embodiment of the hairbrush bristle showing a felt-tipped nozzle design.

Referring to FIG. 11, a third embodiment of a hairbrush bristle 69 can be provided for all three embodiments of the hairbrush 1, 2 and 3 of the invention, wherein the bristle 69 is similar to the bristle 12 (FIG. 9) except that the bristle 69 has a felt-tipped nozzle 70 mounted at a distal end 55 of the bristle 69. A diameter 65 of each bristle 69 is preferably between 1.5 mm and 2.2 mm, and a length 81 is preferably between 1.5 cm and 3 cm, however other sizes can be provided as well. The felt-tipped nozzle 70 consist of a seat 71, a distal portion 72 of an absorbent feed rod 73 and an absorbent dispersing unit 74. The absorbent dispersing unit 74 preferably has a cylindrical configuration with a preferable diameter 66 between 2.5 mm and 3.5 mm and can be formed from bundles of fiber or other known materials. A diameter 64 of the absorbent feed rod 73 is preferably between 1 mm and 2 mm, however other sizes can be provided as well. The absorbent dispersing unit 74 is mounted within the seat 71. The distal portion 72 of the absorbent feed rod 73 extends outwardly through a distal opening 75 of the bristle 69 and extends into (adjacent to or into contact) the absorbent dispersing unit 74. A distal end 76 of the absorbent dispersing unit 74 extends outwardly beyond the seat 71 in order to contact the user's scalp during brushing. The seat 71 is preferably made from stainless steel, plastic or other known materials and preferably is hermetically attached (e.g. by adhesives, welding, etc) to the distal end 55 of the bristle 69. Liquid 77 from an absorbent filler unit 78 is supplied to the distal end 76 of the absorbent dispersing unit 74, by means of the liquid 77 passing through the absorbent feed rod 73 to feed a surface 79 of the distal end 76 of the absorbent dispersing unit 74. The liquid 77 disperses from the distal end 76 of the absorbent dispersing unit 74 over the user's scalp upon contact of the distal end 76 with the scalp during brushing. An amount of the liquid 77 that the user can disperse over the scalp from the felt-tipped nozzle 70 partially depends on the size (viz., the diameter 64) of the absorbent feed rod 73 of the bristle 69. Since, the diameter 64 of the absorbent feed rod 73 is limited by the diameter 65 of the bristle 69 (the brush bristle with a relatively large diameter will be very inconvenient for brushing), the main purpose of the absorbent dispersing unit 74 is to increase a dispersion of the liquid 77 from the bristle 69 without enlargement of the diameter 65 of the bristle 69.

The felt-tipped nozzle 70 (FIG. 11) has a shortcoming compared to the roller-ball nozzles 16 and 40 (FIGS. 9 and 10), because the liquid from the felt-tipped nozzle 70 can disperse through the user's hair as well as over the scalp (the liquid from the absorbent dispersing unit 74 can disperse through the user's hair when the distal end 76 of the absorbent dispersing unit 74 contacts the hair), and can therefore make the hair uncomfortably wet. Notwithstanding this possible shortcoming, the felt-tipped nozzle 70 may provide a softer feeling brush for users with a sensitive scalp.

The aforementioned three embodiments of the hairbrush of the present invention are relatively inexpensive to produce and can provide a convenient and efficient hairbrush device that is capable of evenly dispersing low viscosity water-based solutions and other thin and non-viscous liquids over the user's scalp during routine hair brushing.

What is claimed is:

1. A liquid-reservoir hairbrush adapted for dispersing water-based solutions and other thin and non-viscous liquids over a user's scalp during hair brushing, comprising:

(a) a hairbrush body having a chamber;

(b) at least one absorbent filler unit adapted to retain liquid which is placed into the chamber; and (c) a plurality of hairbrush bristles, each having a proximal end and a distal end, the hairbrush bristles being mounted in a vicinity of their proximal ends to the hairbrush body, wherein at least some of the hairbrush bristles comprise:

an elongate body with at least one bore formed therethrough, at least one absorbent feed rod placed into the at least one bore, and a nozzle mounted at the distal end of each hairbrush bristle comprising at least one rotatably mounted roller-ball, wherein the liquid from the at least one absorbent filler unit is supplied through the at least one absorbent feed rod in a direction of the at least one roller-ball, and wherein the liquid will exit the nozzle when the roller-ball makes rolling contact with the user's scalp.

2. The hairbrush of claim 1, wherein the absorbent filler unit is pre-filled with the liquid.

3. The hairbrush of claim 1, further comprising a flexible base mounted to the hairbrush body, wherein the hairbrush bristles are mounted to the flexible base.

4. The hairbrush of claim 1, further comprising a bristle lid to keep the hairbrush bristles enclosed when the hairbrush is not in use and to help prevent the roller-balls from drying out.

5. The hairbrush of claim 4, wherein the bristle lid has a cleaning pad, and wherein the cleaning pad provides cleaning to the nozzles when the bristle lid is closed on the brush bristles.

6. The hairbrush of claim 1, wherein the chamber is divided into at least two separate sections, and wherein these sections are preferably hermetically isolated from one another, and wherein at least one absorbent filler unit is placed into each section.

7. The hairbrush of claim 1, wherein the hairbrush body has a filler inlet to permit the user to refill the absorbent filler unit with liquid.

8. The hairbrush of claim 7, further comprising a liquid refilling unit that is adapted to place liquid into the absorbent filler unit when the filler inlet is opened.

9. The hairbrush of claim 8, wherein the liquid refilling unit is pre-filled with the liquid and is adapted to engage with the hairbrush body when the filler inlet is opened.

10. The hairbrush of claim 1, wherein at least one intermediate transitional absorbent unit is mounted between the at least one absorbent feed rod and the at least one roller-ball, and wherein the liquid from the at least one absorbent feed rod is supplied through the at least one intermediate transitional absorbent unit in the direction of the at least one roller-ball.

11. A liquid-reservoir hairbrush adapted for dispersing water-based solutions and other thin and non-viscous liquids over a user's scalp during hair brushing, comprising:

(a) a hairbrush body having a chamber;

(b) at least one absorbent filler unit adapted to retain liquid and placed into the chamber; and (c) a plurality of hairbrush bristles, each having a proximal end and a distal end, the hairbrush bristles being mounted in a vicinity of their proximal ends to the hairbrush body, wherein at least some of the hairbrush bristles comprise:

an elongate body with at least one bore formed therethrough, at least one absorbent feed rod, each having a proximal end and a distal end, and placed into the at least one bore, and a nozzle mounted at the distal end of each hairbrush bristle comprising at least one absorbent dispersing unit, wherein the at least one absorbent dispersing unit can contact the user's scalp during brushing, and wherein the liquid from the at least one absorbent filler unit is supplied through the at least one absorbent feed rod in a direction of the at least one absorbent dispersing unit.

12. The hairbrush of claim 11, wherein the absorbent filler unit is pre-filled with the liquid.

13. The hairbrush of claim 11, further comprising a flexible base mounted to the hairbrush body, wherein the hairbrush bristles are mounted to the flexible base.

14. The hairbrush of claim 11, further comprising a bristle lid to keep the hairbrush bristles enclosed when the hairbrush is not in use and to help prevent the at least one absorbent dispersing unit from drying out.

15. The hairbrush of claim 14, wherein the bristle lid has a cleaning pad, and wherein the cleaning pad provides cleaning to the nozzles when the bristle lid is closed on the brush bristles.

16. The hairbrush of claim 11, wherein the chamber is divided into at least two separate sections, and wherein these sections are preferably hermetically isolated from one another, and wherein at least one of the absorbent filler units is are placed into each section.

17. The hairbrush of claim 11, wherein the hairbrush body has a filler inlet to permit the user to refill the absorbent filler unit with liquid.

18. The hairbrush of claim 17, further comprising a liquid refilling unit that is adapted to place liquid into the absorbent filler unit when the filler inlet is opened.

19. The hairbrush of claim 18, wherein the liquid refilling unit is pre-filled with the liquid and is adapted to engage with the hairbrush body when the filler inlet is opened.

* * * * *